US005473864A

United States Patent [19]

Scott

[11] Patent Number: 5,473,864

[45] Date of Patent: Dec. 12, 1995

[54] METHOD OF STORING AND DISPLAYING A DOCUMENT

[76] Inventor: James E. Scott, 408 Winona St., Bethalto, Ill. 62010

[21] Appl. No.: 187,816

[22] Filed: Jan. 27, 1994

Related U.S. Application Data

[62] Division of Ser. No. 965,018, Oct. 23, 1992, abandoned.

[51] Int. Cl.[6] ..... B65B 25/14; B65B 5/04; B65B 7/26; B65B 7/28

[52] U.S. Cl. ..... 53/467; 53/468; 53/472

[58] Field of Search ..... 206/45.31, 45.34, 206/204, 449, 454; 220/662; 40/154, 156, 158.1, 1, 341; 53/471, 472, 484, 467

[56] References Cited

U.S. PATENT DOCUMENTS

| | | | |
|---|---|---|---|
| 1,698,323 | 1/1929 | Taylor | 220/662 |
| 1,909,013 | 5/1933 | Ruzicka | 206/45.31 |
| 2,383,132 | 8/1945 | Kohl | 206/45.31 |
| 4,240,240 | 12/1980 | Cohen | 53/472 X |
| 4,646,914 | 3/1987 | Gipson | 206/204 X |

FOREIGN PATENT DOCUMENTS

| | | | |
|---|---|---|---|
| 6645 | 3/1927 | Australia | 206/45.31 |
| 2376041 | 9/1978 | France | 206/45.34 |
| 3530225 | 2/1987 | Germany | 220/662 |
| 214105 | 4/1924 | United Kingdom | 206/45.31 |
| 1044124 | 9/1966 | United Kingdom | 220/662 |
| WO93/10003 | 5/1993 | WIPO | 53/472 |

*Primary Examiner*—Horace M. Culver
*Attorney, Agent, or Firm*—Herzog, Crebs & McGhee

[57] ABSTRACT

A storage apparatus comprising a top piece, a bottom piece, a window, positioning means, and closure means. The top piece and bottom piece are correlatively sized and have a lip around each piece. In use, the lip on the top piece mates with the lip on the bottom piece thereby making a tight seal. The top piece is provided with an opening in which a window is located. The bottom piece is provided with positioning means which maintain the contents placed within the storage apparatus in stable relationship. A plurality of closure means are located on the top and bottom pieces, which mate in semi-permanent relationship. The apparatus may be displayed on a flat surface or located on a wall in accordance with the desires of the user.

4 Claims, 1 Drawing Sheet

METHOD OF STORING AND DISPLAYING A DOCUMENT

CROSS-REFERENCE TO RELATED APPLICATION

This application is a division of application Ser. No. 07/965,018, filed on Oct. 23, 1992, now abandoned.

FIELD OF THE INVENTION

The present invention relates to storage receptacles, and more particularly, to storage and display receptacles capable of preserving documents, such as newspapers or other periodicals, by reducing the harmful effects of light, heat, humidity, and handling.

BACKGROUND OF THE INVENTION

Newsprint is a popular publication medium due to its low price and high absorbency features. Characteristically, it is manufactured from acidic pulp and contains short wood fibers and impurities. Unfortunately, this acidic composition makes newsprint unstable, thus making preservation for extended periods of time impossible without special treatment.

Preservation of newspapers and other documents is important, in particular, to libraries, historical societies, and others with similar interests. But it is also of interest to the ordinary layperson who may wish to save a newspaper with historical significance, such as an assassination, the end of a war, or the arrival of man on the moon, or who may wish to save a personal moment, such as the winning of a medal, a wedding, or the birth of a child, for example. The present invention inherently addresses the requirements of a broad range of publications and documents often selected for collection, storage, and display.

To increase the life of newsprint, it is necessary to reduce its exposure to light or to store it in darkness. It is also necessary to reduce or eliminate its exposure to airborne pollutants and other contaminants. Also, since paper degradation is the result of a chemical reaction which accelerates in the presence of heat, it is desirable to reduce newsprint's exposure to heat and humidity. The present invention is engineered to achieve maximum protection from a wide range of vulnerabilities, while allowing the publication to be displayed and enjoyed.

The present invention is particularly directed to laypersons who wish to preserve a significant event. The device will extend the life of the newspaper for a significant period of time, while allowing it to be displayed for enjoyment. It is therefore an object of the invention to provide a device which will extend the life of a newspaper by reducing the paper's exposure to light, contaminants, and humidity. It is a further object of the invention to provide an easy means for handling and storing the newspaper. It is a final object of the present invention to provide a means of displaying the newspaper for continuing enjoyment. These together with other objects and features, which will be in part apparent and in part pointed out, reside in the details of construction as more fully described and claimed hereinafter.

SUMMARY OF THE INVENTION

The present invention is a storage and display apparatus consisting of four primary pieces. These pieces constitute a front cover, a back cover, a window, and positioning means. The front and back covers are correlatively sized and consist of a rectangular flat surface and four side panels which form a lip completely around the flat surface. The lip around the front cover may be sized slightly larger than the lip around the back cover, so that when the covers are mated the front cover will mate with the lip on the back cover making a tight seal. To maintain the mated relationship of the front and back covers in a preferred embodiment, a plurality of closure means are utilized to maintain the covers in semi-permanent relationship.

The window is located in the upper portion of the front cover and positioned so that when a document, such as a newspaper, is placed within the front and back covers, the newspaper name, headlines, the volume and date of the edition, and the price can be seen. To prevent deterioration of the newsprint due to exposure to light, the window may be tinted to reduce transmission of ultraviolet rays. In a preferred arrangement, the window will also withstand abrasion.

Positioning means is located within the enclosure created by the lip surrounding the back cover to maintain the contents enclosed within the apparatus in stable relationship thereto. In a preferred embodiment, this means will be compressible material placed against the inside of the rectangular flat surface of the back cover.

The storage apparatus may have many embodiments. As will be appreciated, the storage apparatus can be variably sized. In a preferred embodiment, it will be sized slightly larger than a conventional newspaper. It could also be sized to contain a tabloid sized publication or a magazine. Similarly, the window located within the front cover can be sized and located so that a greater portion of the front page is visible. The window can also be beveled to enhance the attractiveness of the storage apparatus. Additionally, the front cover can be formed with an inset which will allow a label or other identifying insignia to be located thereon.

While no particular closure means has been described, it will be understood that a tight seal of the front and back covers is desired to reduce or eliminate contaminants, such as smoke, dirt, etc., coming in contact with the newsprint. One possible closure would be a tab and slot arrangement wherein a tab located on the front cover is slid into a slot which is correlatively located on the back cover. A screw can then be inserted through the back cover and threaded into the front cover. Alternatively, the front and back covers can be provided with a plastic hinge on a first side panel and a tab lock on the side panel oppositely disposed thereto. Various other conventional locking means can also be used.

While the positioning means has been described as compressible material in a preferred embodiment, adjustable clips can also be utilized in either or both the front and back covers. Similarly, the front and back covers can be provided with a plurality of ribs to maintain the contents in stable relationship.

As will be appreciated, the storage apparatus can be displayed by placing it on a flat surface, such as a coffee table, either on its side panel or back cover. However, in another embodiment, the storage apparatus can be provided with means which will allow it to hang on a wall, much like a shadow box.

The storage apparatus can be made of any of a variety of known materials. However, it preferably is constructed of lightweight, yet durable materials so that it can be easily handled and displayed while at the same time protecting the contents placed within. Furthermore, it is preferable that the construction materials be inert so that they will not interact with the acidic composition of newsprint. In a preferred embodiment, the apparatus will be produced from a plastic material, such as polypropylene.

As will be readily apparent, the present invention will provide individuals desiring to preserve a significant event reported in a newspaper or other publication with a compact, inexpensive storage and display apparatus which will increase the life of the newsprint by reducing its exposure to light, by reducing or eliminating its exposure to airborne contaminants, and by protecting the newsprint from changes in humidity. It will also provide an easy means for handling and storing a newspaper. Lastly, it will allow the newspaper to be displayed for continuing enjoyment.

DETAILED DESCRIPTION OF THE DRAWINGS

Figure 1:
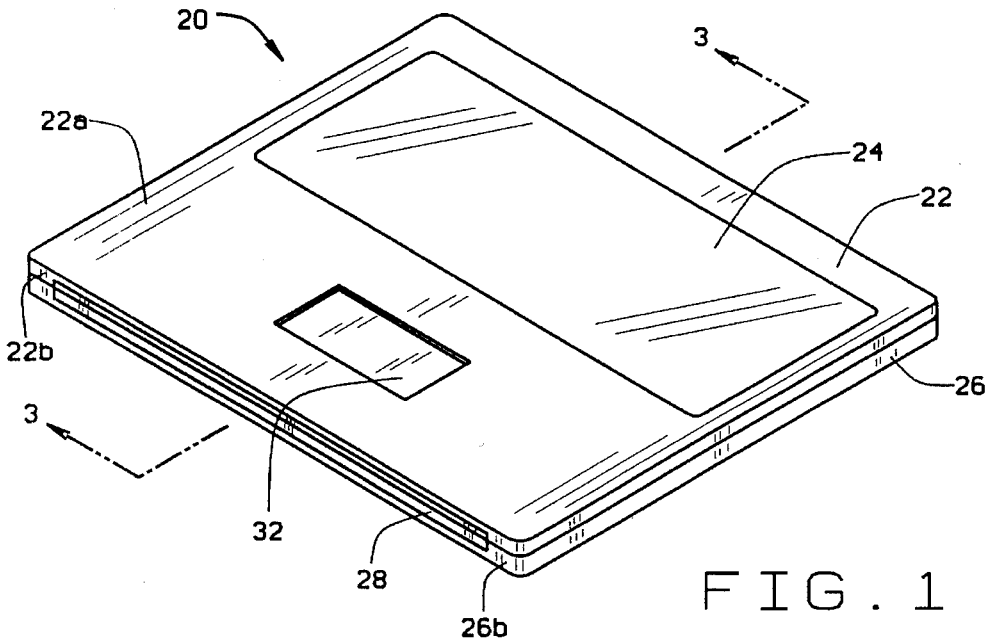
FIG. 1 is a perspective view of a storage apparatus in accordance with the present invention.
Figure 3:
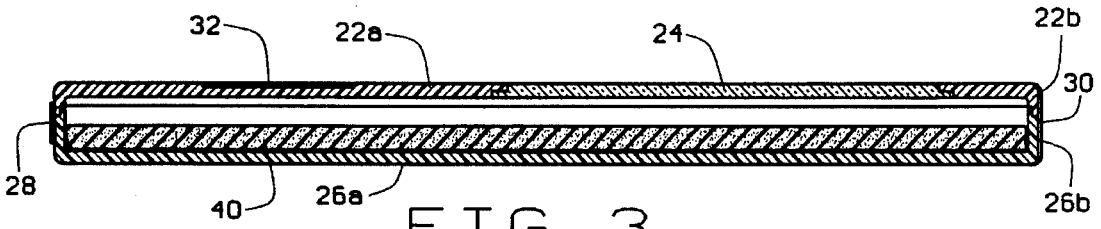
FIG. 3 is a plan view of the side panels showing the lip of the front cover mated with the lip of the back cover.

Referring now to the drawings wherein like reference characters represent like elements, FIG. 1 shows a storage apparatus 20 which is comprised of a top cover 22, a bottom cover 26, and a window 24. Top cover 22 consists of rectangular member 22*a* and side panels 22*b*. Bottom cover 26 consists of a rectangular member 26*a* (shown in cross-section in FIG. 3) and side panels 26*b*. As shown in FIG. 3, side panel 22*b* of front cover 22 mates with side panel 26*b* making a tight seal. Window 24 is cut in rectangular member 22*a* of front cover 22. The window can be sized and positioned relative to that portion of the document enclosed within, which is desired to be displayed. An inset 32 is located proximately to window 24 on member 22*a*. A label or other identifying insignia can be attached to or inserted in the inset. In this embodiment, top cover 22 is mated with bottom cover 26 with a hinge 28. Hinge 28 maintains top cover 22 and bottom cover 26 in flexible relationship. One or more closure means 30 are located on the side panel oppositely disposed to hinge 28. Closure means 30, in conjunction with hinge 28, maintain top cover 22 and bottom cover 26 in the desired fixed, semi-permanent relationship.

Figure 2:
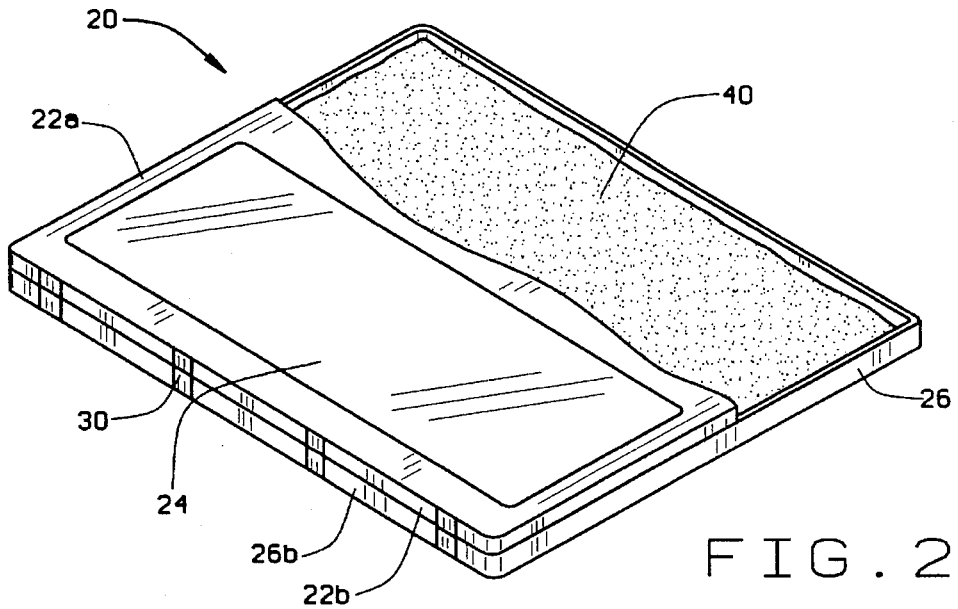
FIG. 2 is a perspective view of a storage apparatus in accordance with the invention, with the front cover of the device being shown in the closed state, part of the cover being cut away to make the interior of the apparatus visible. The storage apparatus in this figure is rotated 180 degrees from the view shown in FIG. 1.

In FIG. 2, part of front cover 22 of storage apparatus 20 is cut away. As shown, positioning means 40 is positioned on top of the rectangular member of bottom cover 26. In a preferred embodiment, positioning means 40 is a layer of compressible foam, which is correlatively sized to fit within the rectangular member of bottom cover 26. Positioning means 40 is of sufficient depth to hold the document enclosed within apparatus 20 in stable relationship with front cover 22.

From the foregoing description, it will be readily understood that a newspaper is placed on the foam positioning means located within the back cover of the apparatus, so that the headline and other information of interest will show through the window of the front cover. The front cover is then mated with the back cover to create a tight seal protecting the newspaper from sunlight and other airborne contaminants. The front and back covers are then locked together by a tab and slot arrangement or other closure means. As will be appreciated, the storage apparatus may be sized such that a newspaper will be held within in stable relationship to prevent slippage. If desired, a cover means may be provided in conjunction with the window to further protect the document from exposure to light. Likewise, a small quantity of a desiccant material, suitably packaged, can be included within the storage apparatus to further protect the document contained within from moisture.

Although the present invention has been described and illustrated with respect to a preferred embodiment thereof, it is to be understood that it is not to be so limited, since changes and modifications may be made therein which are within the full intended scope of this invention as hereinafter claimed.

What is claimed is:

1. A method of preserving a newspaper comprising:

a. providing a container having;

i. a rectangular bottom member with upstanding sidewalls sized to accept a folded newspaper;

ii. a peripheral upstanding flange extending from said sidewalls of said bottom member;

iii. a rectangular top member with a peripheral recess sized and configured to receive and mate with said peripheral flange of said bottom member when said top member and said bottom member are placed in contact with each other, thereby defining an interior chamber to receive and store a newspaper;

iv. an opening formed in said top member, said opening sized to allow viewing of at least the name, date and headline of a newspaper stored in said container, said opening including a peripheral lip;

v. said opening and said lip formed in said top member and positioned to avoid contact with said upstanding sidewalls of said bottom member;

vi. a rigid plastic window held in a fixed position in said lip of said opening in said top member;

vii. said plastic window being transparent and formed from a material to reduce transmission of ultraviolet rays into said chamber, when sunlight passes through said window;

viii. a closure means to selectively lock said bottom member and said top member together; and ix. said bottom member and said top member formed from an opaque material;

b. providing a positioning device comprising a compressible foam sheet sized to substantially the same size as said bottom member of said container;

c. placing the foam sheet onto said bottom member of said container;

d. placing a newspaper on said foam sheet;

e. positioning said top member against the newspaper with said window positioned to allow viewing of at least the name, date and headline of the newspaper stored in said container;

f. registering said top member with said bottom member;

g. pressing the top member against the newspaper to compress the foam sheet; and h. closing said closure means;

whereby at least the name, date and headline of the newspaper are held in firm viewable engagement with said window.

2. The method of claim 1 wherein said closure means includes a hinge joining one side of said rectangular bottom member with the corresponding side of said rectangular top member.

3. The method of claim 1 further including placing a desiccant in said chamber of said container to reduce the moisture content of the atmosphere in said chamber.

4. The method of claim 1 wherein said closure means includes at least one tab located on said top member and at least one slot located in said bottom member, said tab and said slot mating with one another and at least one screw inserted through said bottom member and threaded into said top member to selectively lock said bottom member and said top member together.

* * * * *